United States Patent [19]

Ostermann

[11] 4,377,228

[45] Mar. 22, 1983

[54] COIN CONTROLLED SINGLE MANUAL VEND NEWSPAPER VENDOR

[75] Inventor: Peter Ostermann, Sunnyvale, Calif.

[73] Assignee: Hickey-Mitchell Company, St. Louis, Mo.

[21] Appl. No.: 293,380

[22] Filed: Aug. 17, 1981

[51] Int. Cl.[3] ..... G07F 5/08

[52] U.S. Cl. ..... 194/54; 194/1 G

[58] Field of Search ..... 221/226, 227, 251, 279, 221/228; 194/54, 51, 59, 65, 1 G; 221/213, 241

[56] References Cited

U.S. PATENT DOCUMENTS

| | | | |
|---|---|---|---|
| 1,622,262 | 3/1927 | Kindrat et al. . | |
| 2,832,506 | 4/1958 | Hatcher | 221/227 X |
| 3,125,247 | 3/1964 | Knickerbocker . | |
| 3,464,530 | 9/1969 | Knickerbocker . | |
| 3,831,809 | 8/1974 | Knickerbocker . | |
| 3,884,330 | 5/1975 | Chalabian . | |
| 3,941,227 | 3/1976 | Gordon . | |
| 3,957,175 | 5/1976 | Gordon . | |
| 4,067,477 | 1/1978 | Chalabian . | |
| 4,139,120 | 2/1979 | Moore . | |
| 4,140,242 | 2/1979 | Muller et al. . | |

*Primary Examiner*—Stanley H. Tollberg
*Attorney, Agent, or Firm*—Kalish & Gilster

[57] ABSTRACT

A newspaper vendor has a spring-suspended elevator lifting a vertical stack of newspapers for presentation of successive papers at a vend position for withdrawal by a customer through a vend throat. A roller arrangement automatically aligns the uppermost newspaper with the throat regardless of non-uniform paper thickness. A door, when released, provides customer access to the throat. A door release mechanism is interconnected with a coin mechanism within the vendor to permit door opening upon insertion of coins totalling or exceeding the vend price. A vend control mechanism blocks customer withdrawal of a subsequent paper through the throat during each vend cycle in response to withdrawal of a first paper through the throat, including a latch, a latching mechanism biased for movement from a latched position to unlatched position when released by the latch, and a blocking member driven by release of the latching mechanism for movement within the throat for releasing the latch upon movement of the first paper through the throat, and linkage for relatching the latching mechanism upon closing the door. A throat adjustment mechanism allows quick change of the vertical dimension of the throat according to average newspaper thickness. The vend throat spacing is automatically made slightly greater than newspaper thickness. The coin mechanism allows operation to be changed for vending at either a daily or Sunday vend price.

12 Claims, 22 Drawing Figures

11
15
16
2
10
12
9
2
1
7
13
3
4
2
6

12
42
2
21
20
19

47
46
46'
36
39
40
20
28
25
19
29
26
25'

FIG. 9
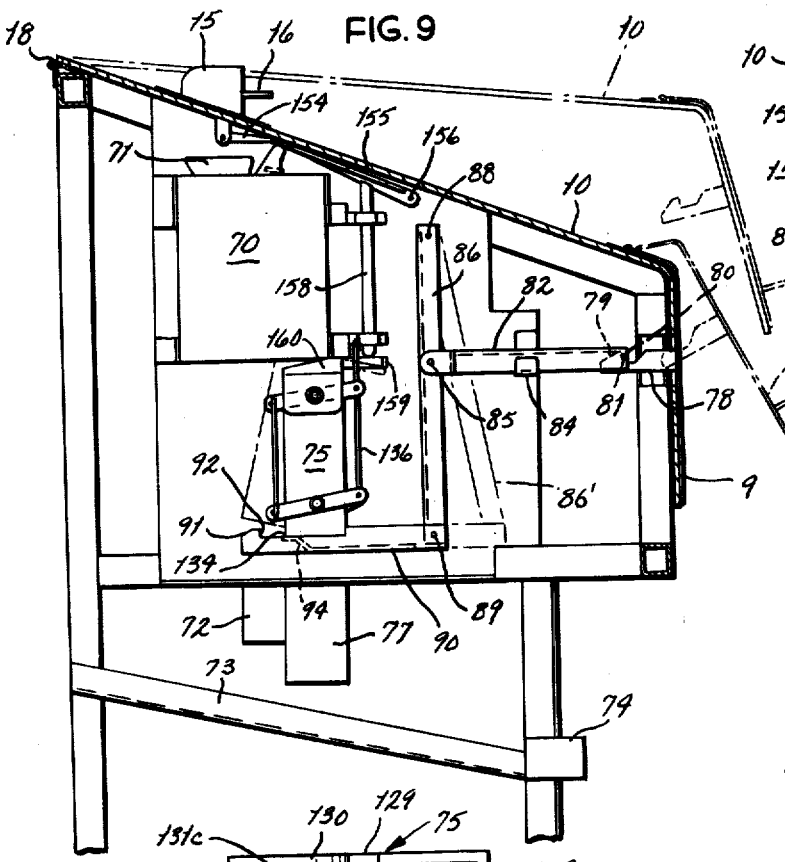
FIG. 10
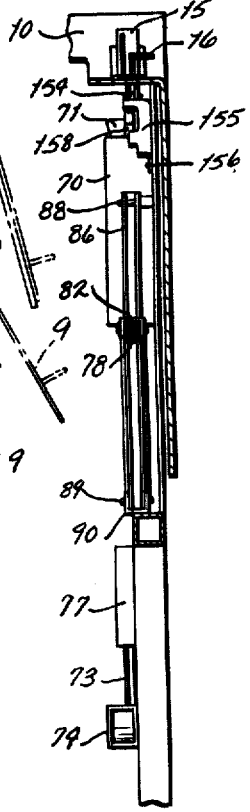
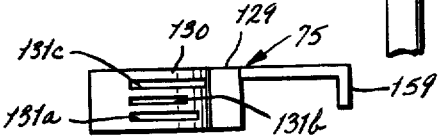
FIG. 14
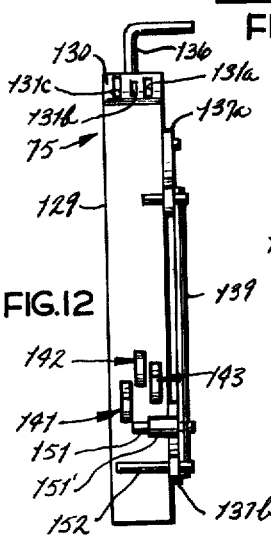
FIG. 12
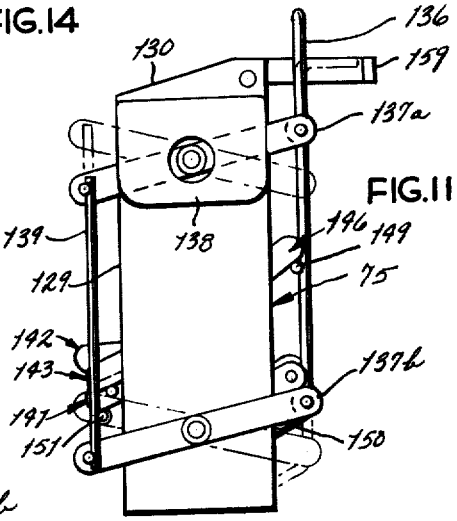
FIG. 11
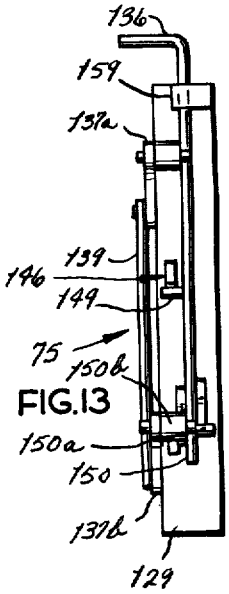
FIG. 13

COIN CONTROLLED SINGLE MANUAL VEND NEWSPAPER VENDOR

BACKGROUND AND SUMMARY OF THE INVENTION

The present invention relates to a dispensing apparatus and, more particularly, to an improved vendor for permitting vending of a single newspaper or the like per vend cycle.

This invention is an improvement of the newspaper vending apparatus described in Ostermann U.S. Pat. Application Ser. No. 24,546, now U.S. Pat. No. 4,299,335.

It is well known to provide newspaper vending machines which permit access to a stack of newspapers upon feeding coins of sufficient value to a coin operated mechanism. Once access is gained, the purchaser may withdraw a newspaper but one must rely only upon the honor and integrity of the purchaser as assurance that no more than a single copy will be taken. Nothing physically prevents a purchaser from withdrawing extra copies of newspapers for which the purchaser has not paid and to which he is not entitled.

To overcome this difficulty, there has theretofore been known a first general type of prior art newspaper vendor which permits withdrawal of a single newspaper. Various mechanisms for this purpose have been suggested, including movement, in response to vending of a first newspaper, of a blocking member into the path of subsequent newspapers for preventing withdrawal until a subsequent vending operation is made possible by insertion of the proper coin in a control mechanism.

A second general type of prior art utilizes a different principle for permitting only a single newspaper to be delivered for each operation of a coin mechanism. In vendors of this type, some sort of paper delivery mechanism is utilized to retrieve a single newspaper copy, e.g., from a stack of newspapers, and to dispense this copy to the customer.

For example, a slide may be used which has a plurality of pointed members which contact the bottom newspaper whereby only it is pulled from the stack upon forward movement of the slide, when released by the coin mechanism. One difficulty inherent in this approach is that the stack is limited in size since the weight of too many newspapers above the lowermost copy which is to be vended may cause binding between copies with consequent tearing or ripping of newspapers during vending, or may create other difficulties in operation.

As will be recognized, newspapers conventionally are folded along the side and in the middle which provide increased thicknesses of the individual newspapers at the side and middle fold. Therefore, when stacked, these nonuniform thicknesses are multipled in effect so that the newspaper stack is, in effect, skewed whereby the uppermost newspaper on the stack is slanted or at a considerable angle to the surface on which the stack is supported.

Although the first type of dispensing apparatus can hold a relatively large stack of newspapers from which the uppermost copy is to be vended, a serious difficulty arises by virtue of this skewing of the stack. This skewing can cause the uppermost newspaper not to be properly aligned for being vended. Therefore, this type of apparatus may jam or fail to properly operate or to present the newspaper in a position in which it can successfully be vended. Or, if it permits the newspaper to be vended, it may cause tearing of the newspaper during vending.

The vendor described in said Ostermann U.S. Patent Application Ser. No. 24,546 is of the type providing vending of a single newspaper per vend cycle. To permit reliable vending operations regardless of various possible thicknesses of the newspaper, an advantageous mechanism is disclosed therein for adjusting and preselecting the dimensions of the vend channel. However, upon testing under conditions representative of normal usage, it has been found that such vend channel adjustment mechanism requires greater time to adjust than is desired. This vendor also has a mechanism for causing newspapers to be presented in alignment with the vend throat having elements which must be moved out of the way for loading of a fresh stack of newspapers into the vendor. This requires a separate step in the reloading of the vendor which it is desired to obviate to save time and provide greater convenience.

Accordingly, an object of the present invention is the provision of an improved vendor for permitting vending of a single newspaper or other publication, per vend cycle.

A further object of the invention is the provision of such a vendor which provides trouble-free single copy vending of newspapers or other publications in response to proper insertion of coins regardless of possible variations in the thickness of the paper or publication, readily handling a wide variation of thicknesses of such newspapers or publications by making possible rapid adjustment accommodative of various thicknesses such as typical of different newspaper editions having vastly different numbers of pages from day to day.

A further object of the invention is the provision of such a vendor which provides improved reliability for consistent, trouble-free vending of newspapers or other publications without causing damage, tearing, ripping or perforation thereof during vending.

Another object of the invention is the provision of such a vendor which includes an improved vend control mechanism which is reliable in operation, prevents multiple vending during each vend cycle, cannot be jackpotted, is not easily defeated or rendered inoperable, is simple and reliable in operation, and is conductive to production line manufacture.

Yet another object of the invention is the provision of such a vendor which not only can contain a large supply of newspapers or similar publications, but also entirely encloses such large supply in the form of a stack to entirely keep elements such as rain, snow, sleet, or ice from damaging publications within the vendor.

A further object of the invention is the provision of such a vendor which displays newspapers to be vended in an easily viewed, unobstructed and attractive manner, allowing the customer to view prior to vending the copy of the paper which will be vended.

A further object of the invention is the provision of such a vendor which includes an improved coin handling mechanism for controlling vend operations, a related object being the provision of a simple, reliable and economical coin handling mechanism which allows convenient, rapid selection between "daily" and "Sunday" vend prices.

Still further objects of the invention are the provision of mechanisms for automatically increasing vend throat vertical spacing for causing same to be slightly greater than newspaper thickness, and for preventing interference with a newspaper being vended by delaying operation of a blocking arrangement which precludes a further paper from being vended during the same vend cycle.

Other objects will be in part apparent and in part pointed out hereinbelow.

BRIEF DESCRIPTION OF THE DRAWINGS

FIG. 9 is a vertical cross-section taken generally along line 9—9 of FIG. 3 illustrating a coin mechanism of the invention and certain linkage associated therewith for controlling a vend cycle.

FIG. 10 is a fragmentary vertical cross-section illustrating portions of such coin mechanism and linkage.

FIG. 11 is a side elevation of the coin mechanism.

FIGS. 12, 13 and 14 are, respectively, rear, front and top elevations of the coin mechanism.

Corresponding reference characters indicate corresponding parts throughout the several views of the drawings.

DESCRIPTION OF THE PREFERRED EMBODIMENT

Figure 1:
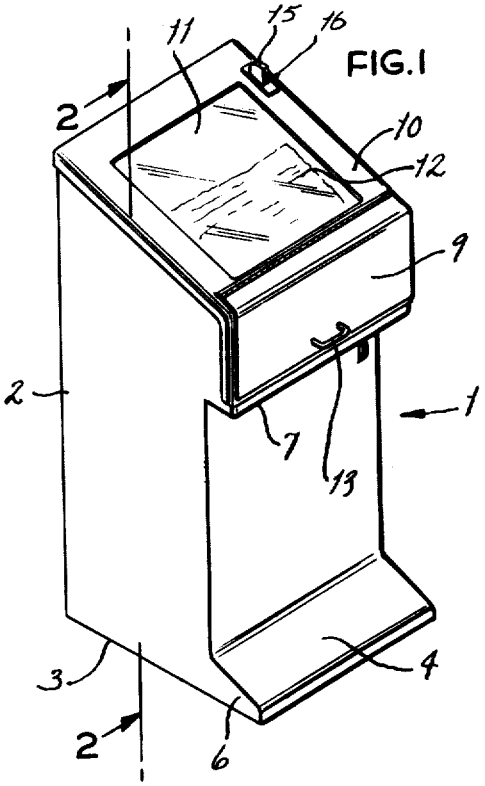
FIG. 1 is a perspective view of a newspaper vendor constructed in accordance with and embodying the present invention.

Referring now by reference characters to the drawings, generally designated at 1 is a vendor of the invention primarily intended for vending newspapers but utilizable also for magazines, tabloids and various other publications of a relatively thin nature which can be stacked. The new vendor has a cabinet 2 constituting an enclosure for containing a large stacked supply of such newspapers or publications which includes a base 3 including an upwardly sloping portion 4 across the front which defines a foot 6. Because of foot 6, said base extends forwardly from cabinet 2 for enhancing support and increasing stability. Cabinet 2 includes an enlarged upper portion including a forwardly projecting extension 7. A door 9 is swingably mounted to a top cover 10 providing a sloping upper surface of the cabinet. Cover 10 includes a viewing window 11 permitting the customer to view a newspaper 12 to be vended upon opening of door 9 by pulling upon a handle 13.

A coin mechanism, described later, and fully self-contained, being housed entirely within cabinet 2, controls vending by permitting opening of door 9 upon insert of a proper amount of coin into a coin chute 15. Adjacent the latter is a coin return mechanism 16.

Preferably, vendor 1 is constructed of a frame of metal defining the shape of cabinet 2 or of strong, resilient synthetic resin material which may be pigmented for providing attractive, permanent coloration of the cabinet while presenting a long lasting surface which is resilient to soiling and discoloration. Further, the sloping upper surface or top 10 and sloping upper surface 4 of foot 6 allow moisture to wash off, and avoid accumulation of dust and dirt to maintain a clean appearance.

As revealed below, said top 10 is hinged at a rearward edge 18 to permit opening for loading of a stack of newspapers or the like into the vendor.

Viewing window 11 is preferably also of synthetic resin material, but of a transparent character for permitting the customer to see the newspaper copy which will be received upon opening of the door 9. This assures the customer not only of receiving a current edition but also that there is at least one newspaper remaining to be vended.

Figure 2:
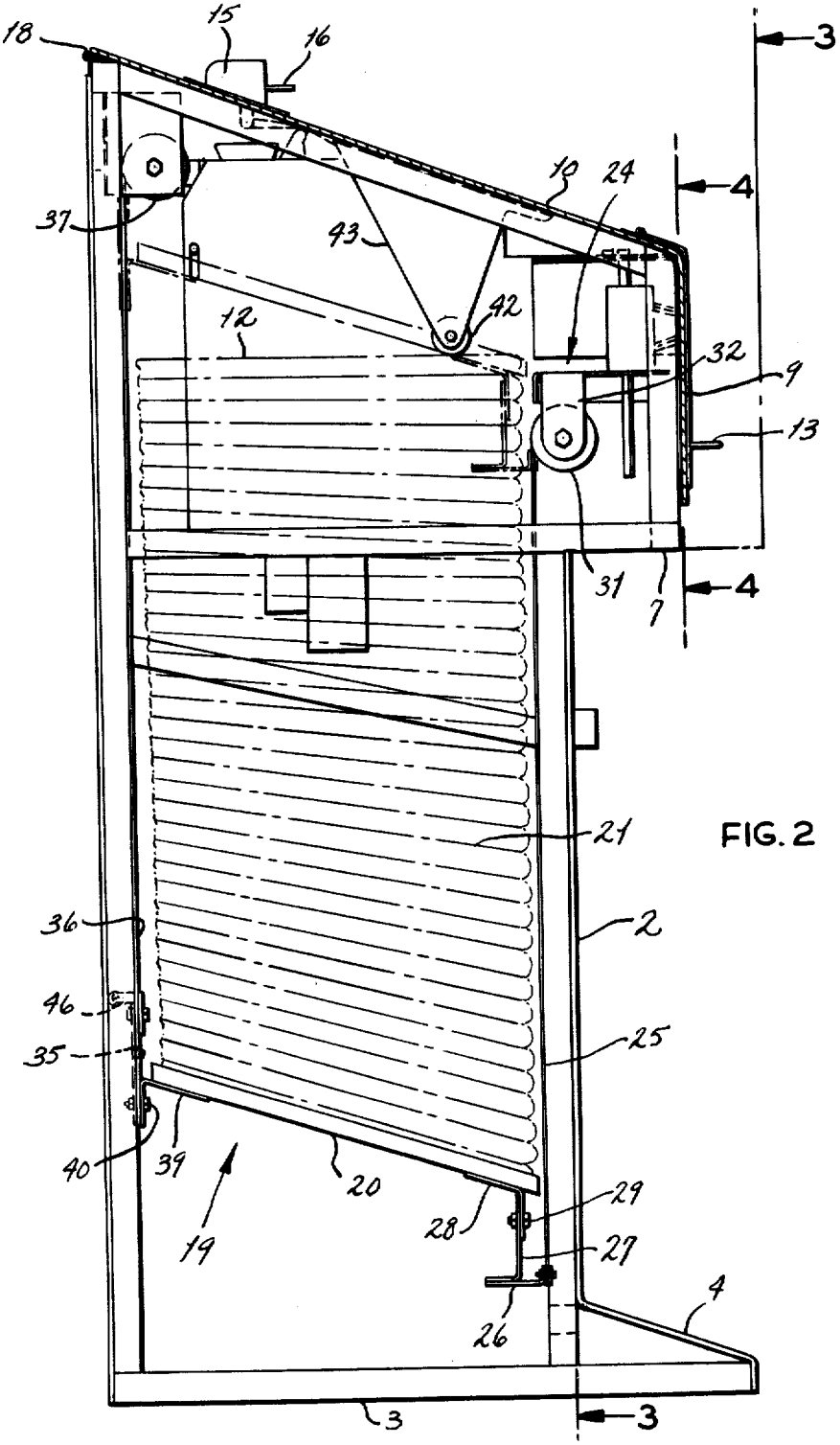
FIG. 2 is a vertical cross-section taken generally along line 2—2 of FIG. 1.
Figure 3:
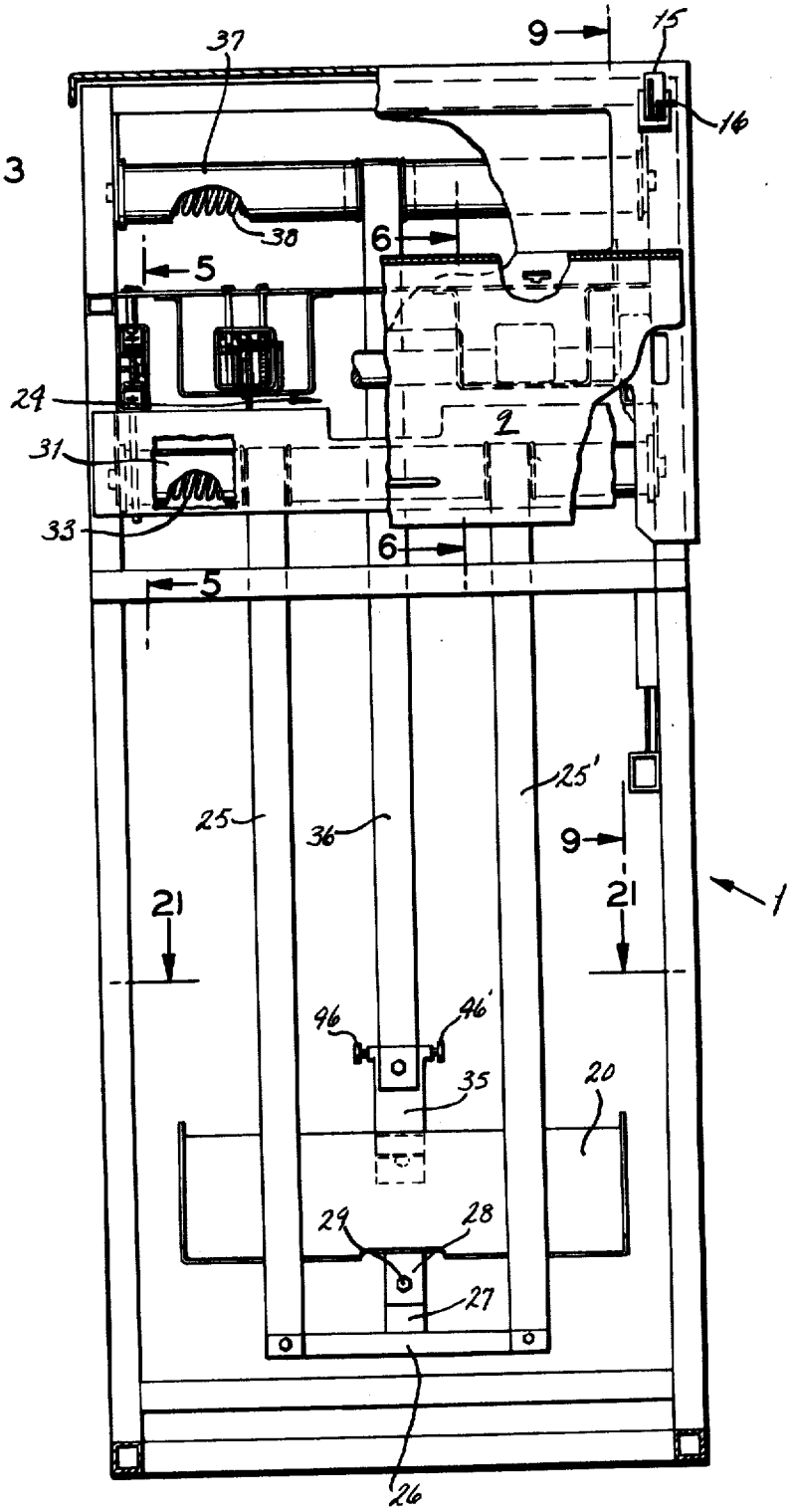
FIG. 3 is a vertical off-set cross-section taken along line 3—3 of FIG. 2.

Referring now to FIG. 2, located within cabinet 2 is a elevator designated generally at reference numeral 19 including an elevator carriage 20 supported at its front and rear, as explained below, for carrying a stack 21 of newspapers to be vended and for continuously lifting said stack for presentation of newspapers to be vended successively from the top of the stack. The uppermost paper 12 is viewable through window 11. Stack 21 is of considerable height and the vendor is capable of containing a much greater number of newspapers than typically has been possible with many other prior art vendors. Stack 21 is vertical.

Newspapers conventionally are folded along the side and then again in the middle, producing a non-uniform thickness across the folded paper since there is greater thickness in the regions of the side and middle folds. Ordinarily, such variations in thickness are not very noticeable and are not a matter of consequence in dealing with but a few newspapers. But when large numbers of newspapers are stacked, the nonuniform thicknesses are effectively multiplied to cause skewing of the stack. I.e., either the stack will lean away from the folds or, if kept from leaning, the stack will be slanted at the top.

Figure 22:
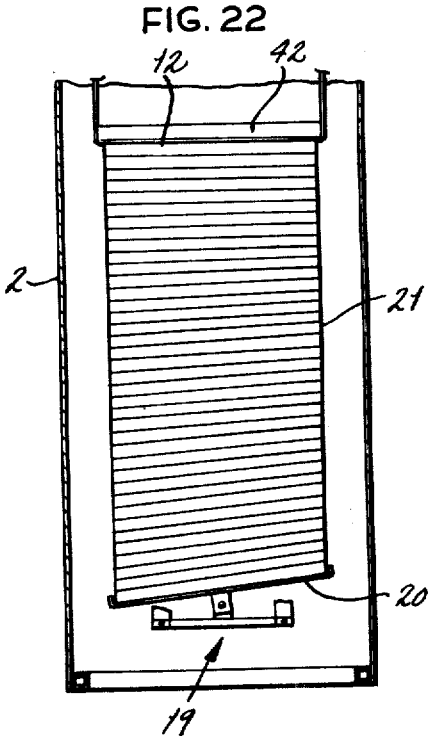
FIG. 22 is a simplified vertical cross-section taken through the center of the new vendor for illustrating the positioning of a stack of newspapers on the elevator carriage.

Referring to FIG. 22, stack 21 is shown to exhibit such skewing but the uppermost newspaper 12 is presented in level condition and so maintained by a roller 42 to be described below. However, it may be generally noted that the roller causes the uppermost copy 12 to be presented in registry with a vend channel 24 (see FIG. 2) through which papers of the stack ultimately will be vended one after the other. Accordingly, elevator carriage 20 is shown tipped in FIG. 22 for accomodating skewing to permit the top of the stack to be level, as viewed from the front. The arrangement for permitting such tipping of elevator carriage 20 is described below.

Platform 20 is supported at its front and rear by stainless steel bands which are wound about drums. Thus, there are provided at the front of the platform two such bands 25, 25' secured at their lower end to a bracket 26 pivotally connected to platform 20 by a further bracket 27. A bracket 28 depends from platform 20 and a bolt 29 pivotally connects the latter to bracket 27 for permitting tipping. Bands 25, 25' are wound about a drum 31 of elongated cylindrical form positioned horizontally at the upper end of the vendor and mounted by bracket as shown at 32 (FIG. 2).

A coiled tension spring 33 is maintained in a state of tension within drum 31 to maintain bands 25, 25' in a state of tension for constantly urging the front of platform 20 upwardly and permitting bands 25, 25' to wind about the periphery of drum 31 as the platform moves up within cabinet 2. Similarly, at the rear of platform 20, a bracket 35 is interconnected with a single band 36 wound about a drum 37 also having a coiled torsion spring 38 and similarly maintained in a predetermined condition for causing drum 37 for urging the rear of platform 20 upwardly.

Bracket 35 is connected to a further bracket 39 carried at the rear of platform 20 and a pivot bolt 40 connecting these brackets thus permits platform 20 to pivot about an axis extending through bolts 40 and 29. Thus, platform 20 is permitting to tilt or tip to accommodate skewing of stack 21, keeping the uppermost copy level even though the bottom of the stack may tilt as necessary. Because of the spring-loaded drums 31, 37, platform 20 is always urged upward in cabinet 2 for continuously presenting papers to be vended. The uppermost paper 12 of the stack move upward until it contacts a roller 42 secured at opposite ends to brackets, as at 43 (FIG. 2) and rotatable upon movement of the uppermost paper 12 off the stack during vending.

Figure 21:
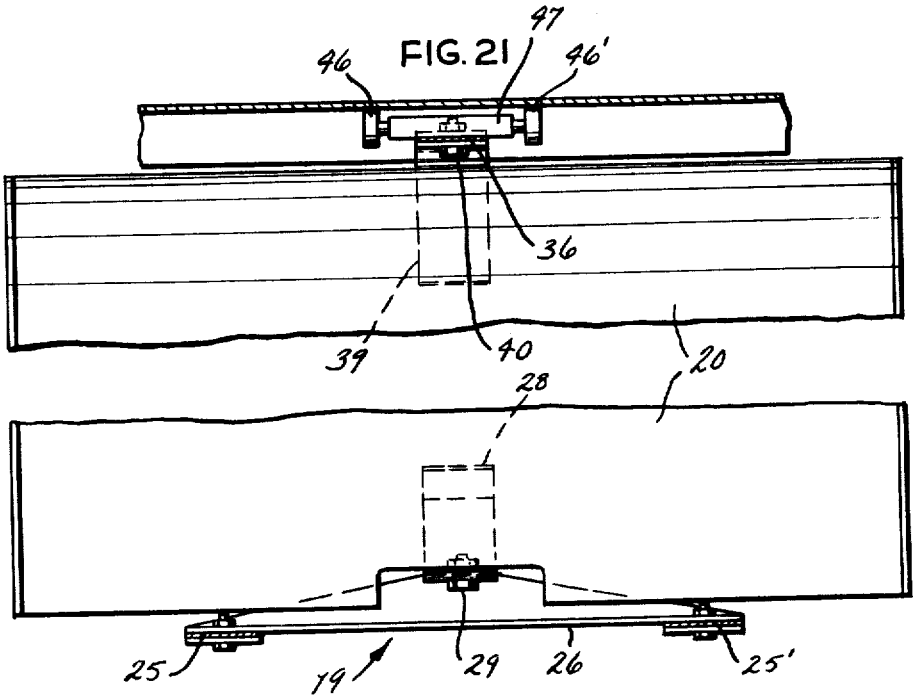
FIG. 21 is a transverse cross-sectional view, taken along line 21—21 of FIG. 3, illustrating a newspaper elevator carriage assembly of the new vendor.

Platform 20 is guided within cabinet 2 throught the extent of its vertical travel by rollers 46, 46' (FIG. 21) which bear against the rear wall of the cabinet. Rollers 46, 46' are rotatably affixed at the opposite ends of an extension 47 affixed to bracket 39.

Figure 7:
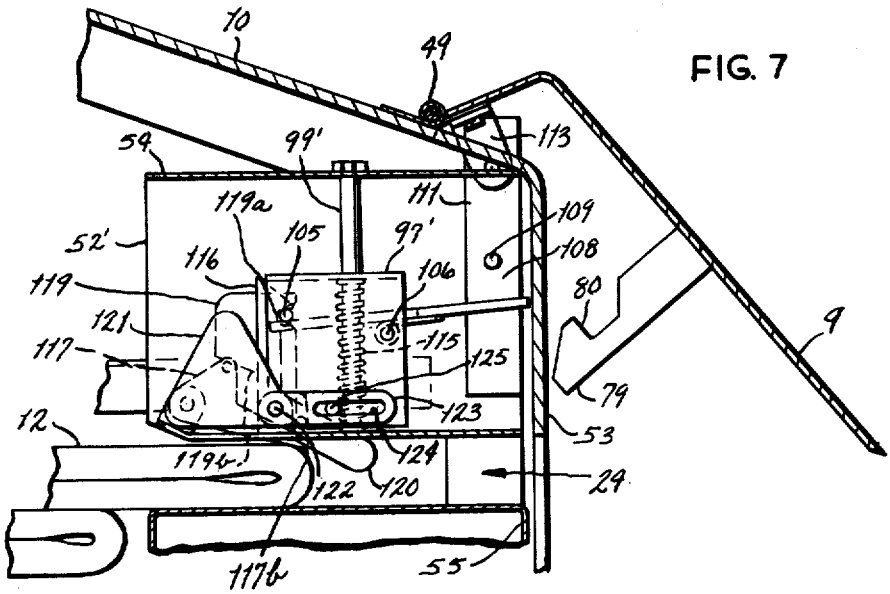
FIG. 7 is a vertical cross-section similar to FIG. 6 showing certain operational aspects of the vend control mechanism.
Figure 8:
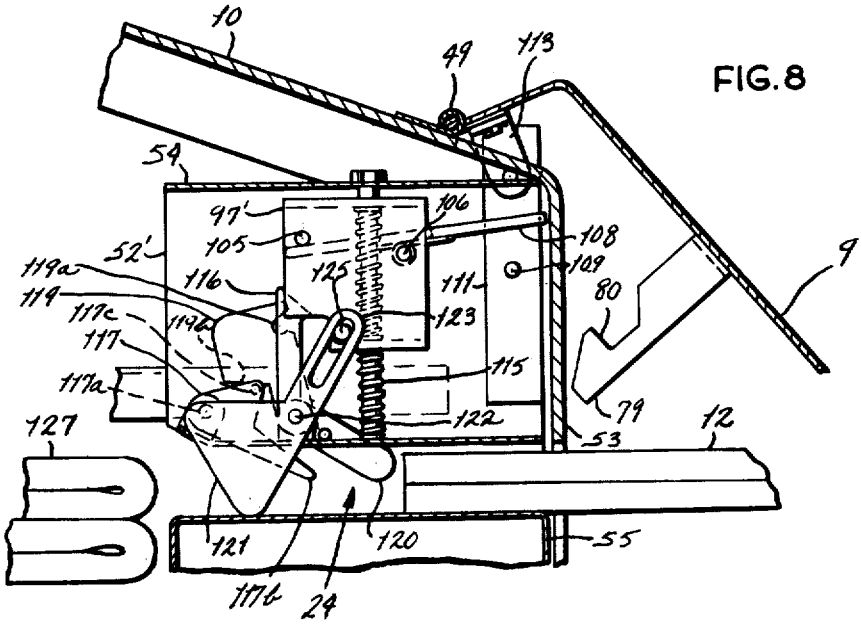
FIG. 8 is a vertical cross-section similar to FIG. 7 and showing further operation of the vend control mechanism.

Vend channel 24 provides a throat through which newspapers are vended when permitted by the vendor upon opening of door 9, which is hinged to top cover 10 by a hinge 49 extending across the width of top 10. A mechanism described below permits cover 9 to be opened upon insertion of a proper amount of coin in coin chute 15. In its open position, as represented in FIGS. 7 and 8, door 9 renders accessible an enlarged portion of throat 24 providing a mouth 50 through which the customer may insert his hand to grip the leading edge of the uppermost paper 12 for pulling it out.

Figure 4:
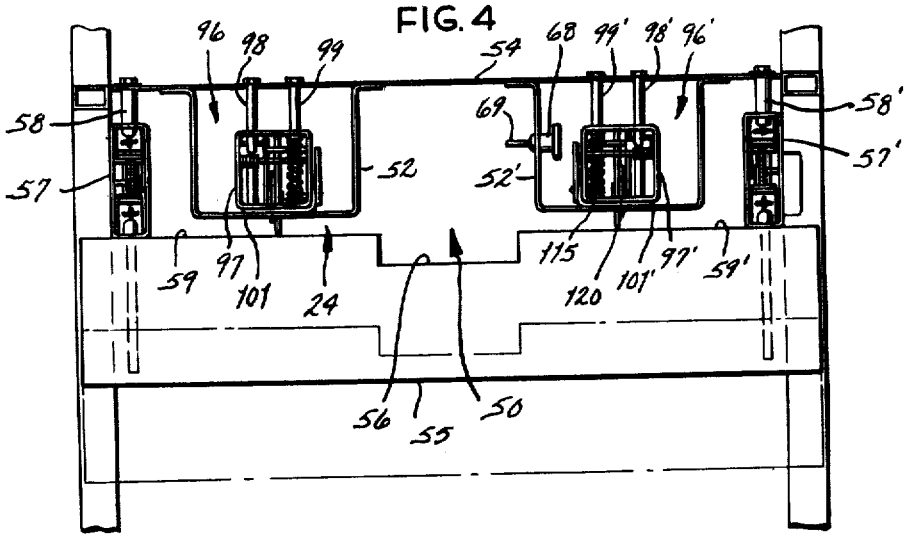
FIG. 4 is a vertical cross-section taken generally along line 4—4 of FIG. 2 and showing a vend control mechanism and adjustable throat carriage mechanism.

On either side of mouth 50 are oppositely disposed housings 52, 52' which are normally covered by a downwardly extending portion 53 of cover 10. In FIG. 4, the housings 52, 52' are shown with the cover and its extensions 53 raised to demonstrate mechanism therein which provides an interlock for permitting only a single copy of the paper to be pulled through throat 24. The housings are secured to a transverse panel member 54 extending across the width of the cabinet. Located below these housings 52, 52' is a carriage 55 including a recessed portion 56 defining in part said mouth.

Carriage 55 is adapted to be selectively moved up and down for varying the height of throat 24 to correspond with the average thickness of newspapers of stack 21 by mechanisms 57, 57' at opposite sides of the throat. These mechanisms are explained below but are to be noted as being made accessible for adjustment of the position of carriage 55 when cover 10 and its extension 53 are raised, as shown in FIG. 4.

Figure 5:
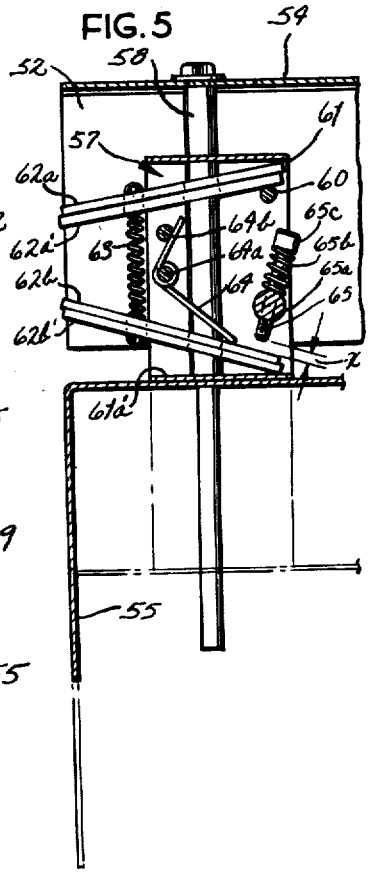
FIG. 5 is a vertical cross-section illustrating a carriage locking mechanism for vend throat adjustment, as taken along line 5—5 of FIG. 3.

Each of said mechanisms 57, 57' is of the configuration shown in FIG. 5 wherein it is seen that member 54 is a panel of sheet metal extending across the width of the vendor and from which depends a pair of rods 58, 58' with respect to which mechanisms 57, 57' are slidable to move up or down upper surfaces 59, 59' of the carriage on opposite sides of recessed portion 56 relative to housings 52, 52'. Mechanism 57 (FIG. 5) is typical.

Secured to the upper surfaces 59, 59' of carriage 55, which is formed of sheet metal, in a housing 61 for mechanism 57 and through which rod 58 extends. Housing 61 includes upper and lower pairs **62*a*, 62*a'* and 62*b*, 62*b'* of oppositely disposed adjustment lever strips which are apertured for receiving rod 58. These pairs of strips are pulled together by a spring 63. The aperture of each strip is of diameter slightly greater than that of rod 58 whereby the rod is gripped by the edges of the apparatus for maintaining carriage 55** in position.

The spring-remote end of strip **62*a'* rests upon a transverse pin 60, as a fulcrum, so that pressure applied from beneath the distal end of strip 62*a'* will disengage both strips 62*a* and 62*a'* from rod 58 for raising of carriage 55. Upon the carriage being lifted, the spring-remote ends of strips 62*b*, 62*b'* are forced against the housing floor 61*a* by one end of a coiled wire spring 64 wound about a transverse pin 64*a* and having its other end retained by a transverse pin 64*b***.

FIG. 5 indicates the relative position of the parts just as the carriage has been lifted to its uppermost position by the authorized operator of the vendor (cover 10 having been raised for this purpose to adjust the carriage) and with a newspaper typical of those to be vended having been pulled partly into vend channel 24. Upward movement of carriage 55 stops when surfaces 59, 59' contact this paper. Located a preselected gap or spacing "X" above the spring-remote end of strip **62*b* is the end of an adjustment screw 65 threaded into a rod 65*a* extending across housing 61, and maintained in position by a coil spring 65*b* between the head 65*c* of the screw and rod 65*a*. Head 65*c*** is slotted, or socket-headed, etc. for screwdriver or wrench adjustment to vary spacing "X".

Accordingly, as lifting pressure is taken off strip **62*a'*, weight of carriage 55, acting against strips 62*b*, 62*b'* as they grippingly bit the surface against rod 58, causes the spring-remote end of strip 62*b* to be moved up into engagement with the outer end of screw 65. This translates into a predetermined downwardly spaced movement of carriage 55 corresponding to spacing "X". This movement spaces the surfaces 59, 59' of the carriage below the newspaper by this predetermined distance. Hence, the resultant vend throat 24 has a dimension approximately equivalent to the newspaper thickness plus "X", the predetermined spacing increment. By adjusting screw 65, this additional spacing may be varied preferably from 0 to 0.375 in. In this way, a proper vend throat dimension is always automatically and perfectly produced which is just slightly greater than the newspaper thickness by the proper predetermined spacing established by screw 65. There are set screws, as at 65**, for the above-described rod gripping mechanisms at each side of the carriage. Thus, each side of the carriage is provided with a lost motion arrangement for preselecting a lost motion adjustment for the carriage, automatically permitting downward movement of the carriage over a predetermined spacing or incremental distance after having been raised.

Downward movement of carriage 55 is caused by pressing downward on the distal end of strip 62b, and its counterpart until pressure is released. This simple, automatic carriage adjustment arrangement for movement up or down avoids confusion and annoyance for the operator and makes it more likely that the operator will adjust the carriage to correspond with newspaper thickness to avoid a situation where the vend channel is either so high that double vending might be attempted by customers or is so constricted that vending would be difficult. If complicated, adjustment might not be carried out properly.

As noted, normally, adjustment mechanisms 57, 57' and the latch or interlock mechanism with housings 52, 52' are concealed by cover extension 53 when top 10 is closed, thus rendering these mechanisms inaccessible to the customer. Top 10 is maintained in its closed position by a lock 68 which the authorized operator may open with a key 69, shown inserted. When locked, lock 68 engages a suitable tang (not shown) or extension of cover portion 53. The operator easily may reach into mouth 50 to insert the key for gaining access for adjustment to fill or replace newspapers of stack 21 by swinging cover or top 10 out of the way. It is noted that brackets, as at 43, which mount roller 42 are carried by top 10. Thus, roller 42 is raised out of the way for access to the interior of the vendor when replenishing newspapers. Top 10 is hinged at its rear by a hinge extending across the width of cabinet 2; movement of top 10 from its closed to an open position being demonstrated in FIG. 9.

The general layout of the mechanism for permitting opening of door 9 during a vending cycle is also revealed in FIG. 9, wherein it is noted that affixed to the inside of cabinet 2 is a slug rejector 70 of conventional commercially available type having a coin inlet or chute 71 for receiving coins inserted through chute 15 and rejecting coins through a discharge chute 72 if bent, or of wrong size or improper type (such as a slug) for return via a coin return chute 73 which terminates in a coin return bin or outlet 74 but otherwise permitting coins to be transferred to a coin mechanism, generally 75, of novel design in accordance with the present invention. A suitable coin box of appropriate configuration is located below coin mechanism 75, as shown at 77, for receiving coins passing from coin mechanisms 75 in the course of a vend cycle. Various coin box variations are possible.

Door 9 carries on its inner face a latch extension 78 having a ramped nose 79 defining a shoulder 80 which upon closure of door 9 will engage and then be retained or latched by a nose 81 at one end of a lever 82. This lever extends slidably through a fitting 84, in which it may pivot, and is pivotally connected at the other end, at 85, to a lever 86.

Anchored at its upper end at a pivot 88, lever 86 extends vertically downward to a pivotal interconnection 89 with a horizontal lever or pawl 90 having at its pivot-remote end a tapered nose 91 defining a shoulder 92 adapted for engaging the lower edge of coin mechanism 75. If one were to attempt opening of door 9 without proper insertion of coin, movement of lever 82 would pull shoulder 92 into engagement with coin mechanism 75, blocking further door movement.

But, if a proper amount of coin is received by coin mechanism 75, the coin acts against a sloping shoulder 94 to turn pawl 90 downward away from mechanism 75, permitting clearance of shoulder 92 and thus allowing linkage movement for permitting door 9 to begin opening upon such linkage movement causing link 86 to occupy position 86'. Angular reorientation of lever 82 frees nose 81 from shoulder 80 of door latch extension 78. Thus, disengaged, door 9 may be fully opened for customer access to a newspaper through mouth 50. Elements of latch mechanism are explained below.

Referring now to FIG. 4, housings 52, 52' contain interlock mechanisms 96, 96' which permit only a single newspaper copy to be vended during each vend cycle. Although they are visible in FIG. 4, it will be understood that, like throat adjustment mechanisms 57, 57', the interlock mechanism 96, 96' are normally obscured by top cover extension 53 when lid or top 10 is closed and locked and, thus, are never visible or accessible to the customer.

Mechanisms 96, 96' each include respective latching mechanisms, including assemblies 97, 97' of box-like frame configuration which are vertically slidable between latched and unlatched positions on corresponding vertical rods 98, 98' and 99, 99'. These mechanisms may either be identical or mirror images of one another, so that description of one suffices.

Figure 6:
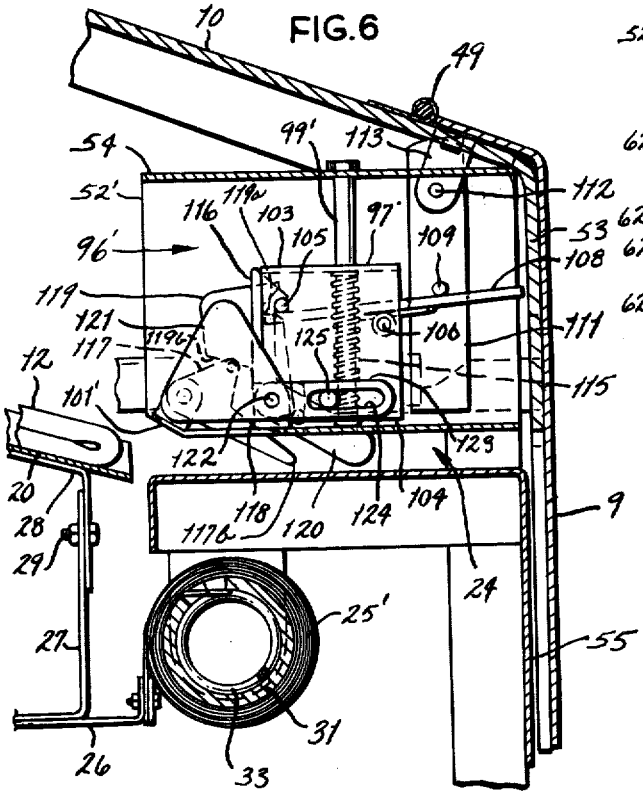
FIG. 6 is an enlarged vertical cross-section taken generally along line 6—6 of FIG. 3 and showing portions of the vend control mechanism and adjustable throat carriage mechanism.

Accordingly, referring to FIGS. 6–8 which show mechanism 96' by cross-section taken through housing 52', it is evident that said vertical rods extend downwardly through transverse panel members 54 to the bottom panel 101 of housing 52'. Assembly 97' includes upper and lower plate members 103, 104 apertured for sliding vertically upon rods 98', 99'. Pins 105, 106 extend transversely across assembly 97' and secured thereto is a resilient metal lever 108 which extends forwardly from assembly 97' for being contacted by a pin 109 carried by a lever 111 pivotally secured at 112 to a tab 113 extending inwardly from door 9. Lever 108 and, thus also, assembly 97' will be carried downward by pin 109 upon closing of door 9 at the termination of a vend cycle, and with the elements of mechanism 96' being shown in FIG. 6 in their portions occupied at such time, being thus reset upon completion of vending.

Assembly 97' is urged upwardly by a coiled compresion spring 115 which bears against panel 101 and member 103, but the assembly remains latched by a latch arm 116 secured at its lower end to a bracket, as at 118, secured to bottom panel 101. The end of lever 116 has a shoulder engaging pin 105 to latch assembly 97' as shown.

Carried also by shaft 122 is a lever 120 providing a trigger to be contacted, as shown in FIG. 7, by movement of the uppermost newspaper copy 12 through throat 24 by the customer for allowing release of assembly 97' for upward movement to cause rotation of a triangular blocking member or blade 121 about shaft 122 mounted by a bracket 118. For this purpose, an arm 123 carried by shaft 122 includes a slot 124 through which extends a pin 125 carried by assembly 97'.

However, means are provided for preventing upward movement of assembly 97; and for preventing the blocking member 121 from pressing against the paper and causing drag to interfere with the paper being vended, until the newspaper has been drawn substantially entirely through vend channel 24. This mechanism includes a paper sensor 117 consisting of a lever pivoting at 117a upon a tab at the rear of panel 54 and having a pointed tip or nose 117b depending into vend channel 24 for being contacted by a paper during vending. Sensor 117 includes a shoulder having a laterally projecting pin 117*c* adapted to control movement of an auxiliary latch 119.

Latch 119 is freely pivotal upon shaft 122 and includes a notch 119*a* which can engage pin 105 for preventing assembly 97′ from being released even though trigger 120 is contacted by a paper. A shoulder 119*b* of member 119 is contacted by pin 117*c* to keep notch 119*a* about pin 105. When sensor nose 117*b* is contacted by paper 12 being withdrawn, member 119 being prevented from rocking back as long as a paper raises sensor 117. However, upon the trailing edge of the paper clearing sensor nose 117*b*, as in FIG. 8, the sensor is free to rotate clockwise under its own weight, and so permitting lock member 119 to rotate counterclockwise through a small angle for freeing pin 105. Assembly 97′ is then driven upward by spring 115, moving blocking member 121 into the vend channel or throat 24 to block subsequent withdrawal of a paper during the same vend cycle.

Subsequently, the closing of door 9 under its own weight drives assembly 97′ down to the latched position, as hereinabove explained, thereby to reset each of mechanisms 96, 96′ for a further vend cycle.

Referring to FIGS. 11–13, coin mechanism 75 includes a generally rectangular housing or body 129 provided with a slightly sloping upper surface 130 defining three coin slots 131*a*, 131*b*, 131*c* for receiving nickels, dimes and quarters, respectively, from rejector 70. Said slots open into respective chutes 132*a*, 132*b*, 132*c* (FIGS. 15–20) which extend the length of body 125, and through which coins may be received in sequence in stacked, edge-to-edge relationship.

Chutes 132*a*, 132*b*, 132*c* permit the respective nickels, dimes and quarters to pass freely through them and then into contact with pawl 90. The latter prevents the coins from falling from the chutes into the coin box unless a proper number of coins in the chutes corresponding to a preselected vend price will permit shoulder 94 to cam lever 90 downward away from the lower left corner 134 of coin mechanism body 129 for clearance of shoulder 92 (FIG. 9) during a vend cycle.

As explained below, a proper combination of coins in the chutes will cause shoulder 94 to be resisted by the coins for camming pawl 90 downward, whereupon the coins fall into the coin box as the door 9 is opened by a customer for access to a newspaper. But if insufficient money has been inserted, the coin combination does not permit sufficient camming force to be exerted by the coins (which protrude from the lower ends of the respective chutes) for downward movement of pawl 90. In such an event, attempted opening of door 9 merely causes shoulder 94 to engage the lower corner 134 of the coin mechanism, preventing opening of door 9.

In this regard, the new vendor and coin mechanism permit an authorized operator to select either a daily vend price (such as $0.20) or a Sunday vend price (such as $0.35) at which mechanism 75 will permit a vend cycle to take place. For this purpose, there is provided (See FIGS. 9 and 11–13) a price selector rod 136 accessible to the operator when cover 10 is opened to be shifted either up or down respectively corresponding to whether a daily or Sunday vend price is desired. Rod 136 is shown in a position for Sunday vend price operation.

Referring to FIGS. 11–13, rod 136 is pivotally connected to upper and lower transfer arms 137*a*, 137*b* pivotally mounted to body 129 for movement as shown in phantom in FIG. 11 corresponding to positioning of rod 136 down (daily price) or up (Sunday price). A plate 138 bears against arm 137*a* for maintaining same, and, thus, rod 136, in the desired position. Pivotally connected to the opposite ends of arms 137*a*, 137*b* is another rod 139. Rods 136 and 139 each have the purpose of selectively enabling or disenabling operation of certain coin-responsive levers which interact with coins in the chutes.

Figure 15:
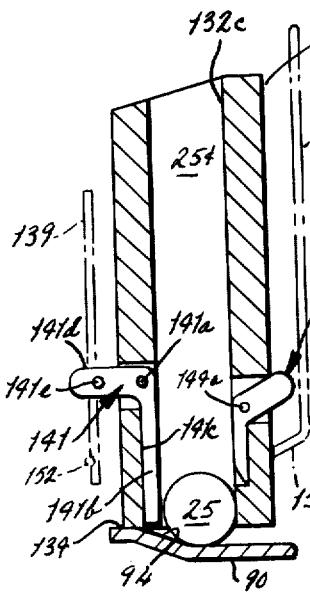
FIGS. 15-20 constitute a series of vertical cross-section of various coin chutes and related elements of the coin mechanism.
Figure 18:
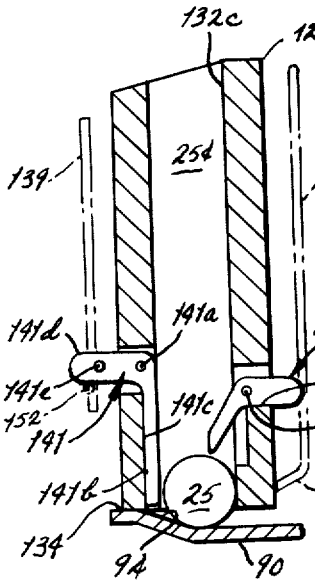
Figure 19:
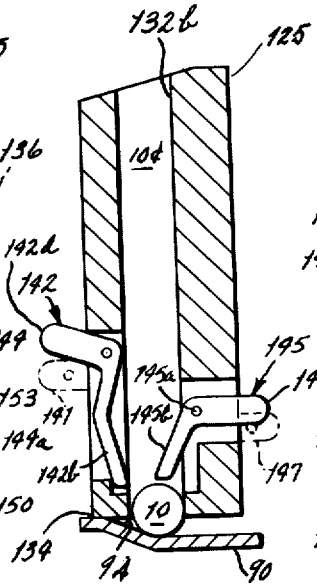
Figure 20:
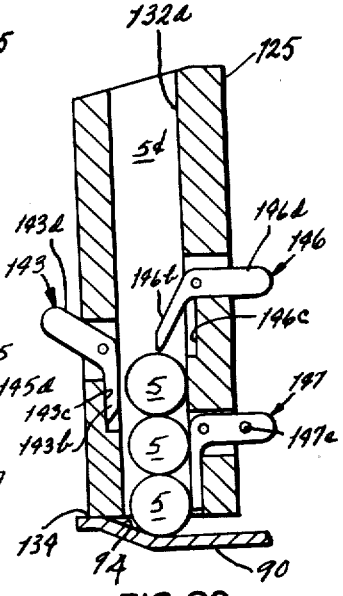

Thus, referring to FIGS. 15 and 18, chute 132*c* is provided with a lever, generally 141, on its left side, pivotally connected at 141*a* and having a vertical portion 141*b* lying within a recess 141*c* of the chute. A lateral extension 141*d* carries a transverse pin 141*e* for engaging corresponding lateral extensions 142*d* and 143*d*.

Each of the chutes is provided on opposite sides with comparable levers, as at 144, 145, 146 and 147 having corresponding reference characters for corresponding parts. Basically, levers 141, 142 and 143, being at the left side, provide Sunday vend price control. Similarly, levers 144, 145, 146 and 147, all on the right, provide daily vend price control.

As best seen in FIG. 11, rod 136 carries a lateral extension 149 for engaging lever 146 and raising its lateral extension 146*d* to cause portion 146*b* to remain in recess 146*c* (FIG. 17) at all times when rod 136 is in its up (Sunday price) position. Lever 146 is thus rendered inoperative for daily price vend operation.

Also, rod 136 carries a similar lateral extension 150*a*, 150*b* for causing levers 147, 144 and 145 similarly to be raised and rendered inoperative for daily price vend operation.

Corresponding lateral extensions 151 (including an enlarged diameter portion 151′) and 152 are carried by rod 139. In the position shown in FIG. 11, neither extension 151 nor 152 interferes with levers 141, 142, 143. But, if rod 136 is lowered for daily price selection, rod 139 is raised for similarly rendering levers 141, 142, 143 inoperative, lever 141 being supported by extension 152, levers 142 and 143 by extension 151 and its portion 151′.

Figure 16:
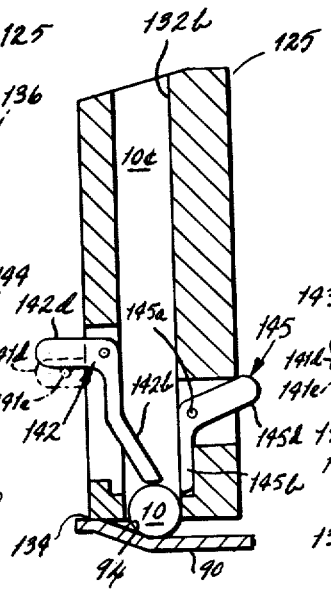
Figure 17:
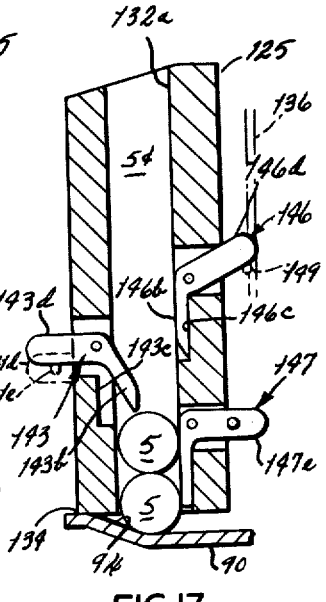

Thus, levers 141, 142, 143 are inoperative for Sunday price selection, while only levers 144, 145, 146, 147 are operative for daily price selection and the manner of operation is then readily perceived to involve these different sets of levers depending on whether daily or Sunday vend operation is selected. FIGS. 15–17 depict combinations for Sunday vending, FIGS. 18–20 combinations for daily vending.

Considering first Sunday operation, and referring to FIG. 15, chute 132*c* is shown with a quarter received therein, after passage through slug rejector 70. Its presence keeps lever portion 141*b* in seat 141*c*, so that pin 141*e* is positioned against lever portion 142*d*. If now the customer inserts a dime, it falls into chute 132*b*, as shown in FIG. 16, momentarily swinging lever portion 142*b* out of the way but then permitting portion 142*b* to swing to the position shown above the dime. This arrangement permits the coin to fall freely into the bottom of the chute yet prevents the coin from moving back up the chute. With $0.35 having been deposited, the customer will pull upon door 9. This pulls pawl 90 to the right. Since pin 141*e* prevents the dime from displacing lower portion 142*b* upward, the dime cams pawl shoulder 94 downward for clearance, permitting door 9 to be opened fully for vending.

Similarly, insertion of a quarter and two nickels, as shown in FIG. 17, results in the lowermost nickel camming pawl shoulder 94 downward, since the quarter detecting lever 141 presents its pin 141*e* beneath at lower edge of lever extension 143*d*, preventing portion 143*b* from being displaced upwardly, even though it is free to swing momentarily into its seat 143*c* upon passage of nickels into chute 132*a*. Upon opening of door 9, pawl 90 clears the three chutes to permit coins therein to fall into the coin box.

Daily price operation involves corresponding lever operation. If the daily vend price is to be $0.15 for example, it is apparent that insertion of at least one nickel in chute 132*a* (FIG. 20) will block movement of lever 147. Then, if a dime is inserted and falls into chute 132*b*, it will deflect lever 145 but it then returns to the position shown in FIG. 19. Since pin 147*e* now prevents extension 145*d* from pivoting clockwise about pivot 145*a*, the initiation of opening of door 9 pulls pawl 90 to the right and shoulder 94 is cammed outward by the dime for clearance of the pawl, permitting door 9 to be opened fully for vending.

Daily vending upon insertion of a quarter (but without return of change) is permitted also. In FIG. 18, chute 132*c* has received a quarter. In dropping to the position shown, the quarter deflects lever 144 which then returns to the position shown, there being a ledge 153 to prevent movement clockwise upon pivot 144*a* beyond the portion shown. Therefore, shoulder 94 is cammed away from the coin mechanism by the quarter upon opening movement of door 9.

This arrangement is easily adapted for vending at higher Sunday or daily prices. For example, for $0.50 vending, lever 141 is positioned relative to the bottom of chute 132*c* so that lever portion 141*b* will, as in FIG. 15, contact only the uppermost of two quarters in chute 132*c*. Similarly, chutes 132*b*, 132*a* and their levers 142, 143 may be dimensioned relatively so that lever portion 142*b*, for example, will swing into position shown above the uppermost of an appropriate number of dimes, and with movement to be resisted by the quarter detecting lever.

Also, the foregoing does not preclude adding additional levers, such as a lever in chute 132*b* for engaging and retaining in place against upward movement the fifth dime inserted. It is apparent also that a similar lever may be provided in chute 132*a* (as in FIG. 17) for detecting and retaining numbers of nickels other than two. Also, for daily vending at higher prices, chute 132*b* and lever 145 may be configured so that portion 145*b* (FIG. 19) will be located above the higher of two or more dimes. The same consideration applies for the nickel chute and the operation of lever 146.

An arrangement shown in FIG. 9 for permitting release of coins without vending includes an arm 154 interconnected with coin release lever 16 for camming down the distal end of a lever 155 pivotally connected at 156 to the vendor framework upon depressing the coin release lever. Slidably positioned for being engaged by lever 155, when cammed downward, is a link 158 for in turn engaging an extension 159 of coin mechanism. The latter is pivotally secured to the vendor framework at 160. Coin mechanism 75 may be retained in the position shown by a spring (not shown) but will thus pivot to the position shown in phantom upon depressing coin release lever 16. This permits release of coins by the coin mechanism upon clearing pawl shoulder 94. The released coins are returned by coin return chute 73.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A vendor for newspapers or the like comprising a housing for containing a vertical stack of newspapers, means for lifting said stack for presentation of successive newspapers of said stack at a vend position for being vended through a vend throat during a vend cycle, characterized by means for causing automatic alignment of newspapers with said throat regardless of non-uniform thickness of individual newspapers of said stack, a door for providing customer access to said throat for permitting an uppermost newspaper from atop said stack to be withdrawn through said throat, a coin mechanism within the housing, and door release means interconnecting said door with said coin mechanism for permitting opening of said door upon customer insertion of a proper coin combination corresponding to the vend price for each newspaper, and single vend control means for blocking customer withdrawal of a subsequent newspaper through said throat during said vend cycle in response to customer withdrawal of a first single newspaper through said throat and comprising a latch, a latching mechanism biased for movement from a latched position to unlatched position when released by said latch, a blocking member driven by release of said latching mechanism for movement from a first position free of said throat to a second position within said throat blocking withdrawal of a second newspaper during said vend cycle, a trigger within said throat for releasing said latch upon customer withdrawal of a newspaper through said throat while said door is open, and means for relatching said latching mechanism upon closure of said door.

2. A vendor according to claim 1 and further characterized by said throat being defined by opposed upper and lower surfaces each extending substantially the width of said newspapers, said throat including an enlarged central portion constituting a mouth for receiving the hand of a customer for withdrawing a newspaper, and housings on opposite sides each independently containing one each of said latch, said latching mechanism, said blocking member and said trigger, blocking members being thereby provided on opposite sides of said mouth for independently blocking on both sides of said mouth withdrawal of a second newspaper during said vend cycle.

3. A vendor according to claim 1 and further characterized by said latching mechanism comprising an assembly mounted for vertical sliding movement, a spring biasing said assembly upward, said latch latching said assembly downward, said assembly being driven upward when said latch is released by said trigger, said blocking member comprising a blade pivotally mounted for swinging from a position free of said throat to a blocking position extending into said throat, an arm extending from said blade and interengaging said assembly for causing said assembly upon being driven upward when unlatched to swing said arm for pivoting said blade into said blocking position, and auxiliary latching means for preventing said assembly from being driven upwardly and for preventing said blocking member from interfering with a newspaper being vended until said newspaper has been drawn substantially entirely through said throat.

4. A vendor according to claim 3 and further characterized by said auxiliary latching means comprising an auxiliary latch configured for latching said assembly downward and a paper sensor for controlling said auxiliary latch, said paper sensor being actuated by the movement of a newspaper through said throat for causing movement of said auxiliary latch into an assembly latching position and being responsive to passage of the trailing edge of said newspaper through said throat for causing movement of said auxiliary latch out of said latching position thereby to permit said assembly to be driven upward.

5. A vendor according to claim 3 and further characterized by said assembly including structure for being driven downward upon closing of said door for returning said assembly to a latched position.

6. A vendor according to claim 1 and further characterized by said coin mechanism comprising slots for respectively receiving nickels, dimes and quarters inserted in said vendor by a customer, each of said slots being open at the bottom for permitting coins in said slots to fall into a coin box, a door release control pawl extending across the bottom of said slots including a shoulder for bearing against coins in said slots, a first set of levers extending into said slots for interacting with coins therein to determine solely a daily vend price, and a second set of levers extending into said slots for interacting with coins therein to determine solely a Sunday vend price, and means for selectively rendering one of said lever sets operative and the other of said lever sets inoperative thereby to select either daily or Sunday vend price operation.

7. A vendor according to claim 6 and further characterized by said pawl being interconnected with said door for being shifted laterally relative to said coin mechanism upon opening of said door, said pawl having a second shoulder engaging said coin mechanism to prevent said lateral shifting unless coins in said chutes react against the first-said pawl shoulder for preventing engagement of said second shoulder, the operative and first and second sets of levers precluding upward movement within said chutes of coins corresponding to the respective daily or Sunday vend price whereby the first-said pawl shoulder will cause forcing of said pawl away from said coin mechanism for preventing said engagement of said second shoulder thereby for permitting opening of said door.

8. A vendor according to claim 1 and further characterized by said throat being defined by opposed upper and lower surfaces each extending substantially the width of said newspapers, throat adjusting means for selectively adjusting the dimensions of said throat according to the average thickness of each of said newspapers to limit said throat dimensions for permitting a single newspaper to pass therethrough, said throat adjusting means being adapted to selectively alter the spacing between said upper and lower surfaces, the lower surfaces of said throat being constituted by a carriage vertically shiftable within said housing upon vertical supports at opposite sides of said carriage, and means located at opposite ends of said carriage for manually selecting the position of said carriage relative to said supports.

9. A vendor according to claim 8 and further characterized by said vertical supports comprising a pair of vertically disposed rods at opposite sides of said carriage, and a pair of gripping devices at respective opposite sides of said carriage normally grippingly engaging a respective rod to maintain the vertical position of said carriage, said gripping devices each being manually engageable for disengagement from the respective rod for permitting rapid manual vertical shifting of said carriage for adjusting the vertical dimensions of said throat.

10. A vendor according to claim 9 and further characterized by said gripping devices being provided in pairs at the opposite sides of said carriage, there being an upper and lower gripping device each manually engageable for respectively raising and lowering said carriage, and means associated with each said gripping device to provide automatically for adjustment of said vend throat to provide vertical spacing thereof which is the thickness of a newspaper plus a predetermined spacing increment.

11. A vendor according to claim 10 and further characterized by said gripping mechanisms comprising apertured strip-like levers, each having apertures for receiving a respective rod, and an adjustable stop associated with the lower levers for preselecting a lost motion adjustment therefor to automatically permit downward movement of said carriage over a predetermined incremental distance upon having been manually raised.

12. A vendor for newspapers or the like comprising a housing for containing a vertical stack of newspapers, means for lifting said stack for presentation of successive newspapers of said stack at a vend position for being vended through a vend throat during a vend cycle, characterized by means for causing automatic alignment of newspapers with said throat regardless of non-uniform thickness of individual newspapers of said stack, a door for providing customer access to said throat for permitting an uppermost newspaper from atop said stack to be withdrawn through said throat, a coin mechanism within said housing and door release means interconnecting said door with said coin mechanism for permitting opening of said door upon customer insertion of a proper coin combination corresponding to the vend price for each newspaper, and single vend control means for blocking customer withdrawal of a subsequent newspaper through said throat during said vend cycle in response to customer withdrawal of a first single newspaper through said throat and comprising a blocking member movable into said throat upon customer removal of a first newspaper for blocking withdrawal of a second newspaper during said vend cycle and resettable upon closure of said door, said throat being defined by opposed horizontal upper and lower surfaces each extending substantially the width of said newspapers, throat adjusting means for selectively adjusting the vertical dimensions of said throat according to the average thickness of each of said newspapers to limit said throat dimensions for permitting a single newspaper to pass therethrough by selectively altering the spacing between said upper and lower surfaces, the lower surfaces of said throat being constituted by a carriage vertically shiftable within said housing between locked positions upon vertical supports at opposite sides of said carriage, and including means located at opposite ends of said carriage for manually unlocking the carriage and selecting the position of said carriage relative to said supports, said coin mechanism comprising slots for respectively receiving nickels, dimes and quarters inserted in said vendor by a customer, each of said slots being open at the bottom for permitting coins in said slots to fall into a coin box, a door release control pawl extending across the bottom of said slots including a shoulder for bearing against coins in said slots, a first set of levers extending into said slots for interacting with coins therein to determine solely a daily vend price, and a second set of levers extending into said slots for interacting with coins therein to determine solely a Sunday vend price, and means for selectively rendering one of said lever sets operative and the other of said lever sets inoperative thereby to select either daily or Sunday vend price operation.

* * * * *